United States Patent [19]

Artusi

[11] Patent Number: 5,029,750

[45] Date of Patent: Jul. 9, 1991

[54] RECEPTACLE

[76] Inventor: Aldo Artusi, Muhleboden 661, CH-8461 Trullikon, Switzerland

[21] Appl. No.: 523,060

[22] Filed: May 14, 1990

[51] Int. Cl.[5] ..... B65D 5/24

[52] U.S. Cl. ..... 229/125.35; 426/106; 426/115; 220/23.86

[58] Field of Search ..... 426/393, 115, 107, 106; 220/23.86, 23.83, 23.8; 229/125.35

[56] References Cited

U.S. PATENT DOCUMENTS

| | | | |
|---|---|---|---|
| 4,013,798 | 3/1977 | Goltsos | 426/107 |
| 4,304,352 | 12/1981 | Humphries | 229/125.35 |
| 4,328,254 | 5/1982 | Waldburger | 426/115 |
| 4,399,159 | 8/1983 | Guibert | 426/393 |
| 4,531,668 | 7/1985 | Forbes, Jr. | 229/125.35 |
| 4,889,731 | 12/1989 | Williams, Jr. | 426/106 |
| 4,935,252 | 6/1990 | Huang et al. | 426/393 |

*Primary Examiner*—Joseph Man-Fu Moy

*Attorney, Agent, or Firm*—Bachman & LaPointe

[57] ABSTRACT

In a receptacle for receiving products, in particular food, to be heated up, for example in a baking oven, microwave oven or the like, a container tray (1) is provided at least partially with an approximately horizontally projecting rim strip (7). The latter has a supporting strip (8) of a blank (P) placed beneath it, while a film, a cover or the like is situated on the rim strip (7). For this purpose, the blank (P) has a continuous supporting strip (8) which is separated from end strips (11) and wall strips (10) respectively, arranged towards the inside of the blank, by fold lines (12) or the like, the fold lines (12) running inside that region of the blank (P) covered by the rim strip (7).

13 Claims, 2 Drawing Sheets

RECEPTACLE

The invention relates to a receptacle for receiving products, in particular food, to be heated up, for example in a baking oven, microwave oven or the like, a container tray being provided at least partially with an approximately horizontally projecting rim strip and the latter having a supporting strip of a blank placed beneath it, while a film, a cover or the like is situated on the rim strip.

A container of this type is known, for example, from German Patent Specification 3,506,253. In this patent, a blank has side walls, a base and rim strips projecting approximately horizontally from the side walls. These rim strips are connected to the lateral rim collar of the tray. A film is furthermore sealed onto the rim collar.

In the use position, these rim strips form a continuous rim such that the rim collar of the tray is supported on all sides. In practice, however, it has proved to be the case that the rim strips, if they are not flush-joined neatly, make it more difficult to seal the film as unevennesses may occur at points where two rim strips meet.

In addition, the waste which is caused in the production of the blank corresponding to German Patent Specification 3,506,253 is relatively high.

The inventor has set himself the object of improving the abovementioned receptacle in such a way that the impermeability of the receptacle is considerably improved and the sealing of the film is made easier. The intention is furthermore that the waste from the production of the blank be minimized. The overall principle is to manage to produce the blank with as small as possible expenditure on materials.

In order to achieve this object, the blank has a continuous supporting strip which is separated from end strips and wall strips respectively, arranged towards the inside of the blank, by fold lines or the like, the fold lines running inside that region of the blank covered by the rim strip.

A blank of this type thus has, in its strictly necessary embodiment, no greater size than that formed by the rim strips which it is to underpin. It is, of course, possible, if desired, to design the supporting strips wider than the rim strip beneath which they are to be placed.

It is, however, not essential and the supporting strip could, in contrast, also have a smaller width than the rim strip.

The essential advantage of this is that the supporting strip is designed to be continuous so that no joining gaps occur which could lead to unevennesses in the rim strip when the film is sealed on, which in turn influences the impermeability.

There is an obvious saving on materials as only the material of the blank which is situated inside the region of the continuous supporting strip is used to develop its functional form. If the receptacle has a rectangular shape, for example, the waste between the individual blanks can as a result be kept to a minimum, or even completely eliminated.

The actual support of the rim strip is effected via bearing rims of wall strips and end strips. These bearing rims have a width or a height, measured perpendicular to the corresponding fold line, where width and height preferably correspond. This results in the formation of a bearing plane which determines the position of the receptacle.

Width and height are selected such that they correspond approximately to the height of the side wall or end wall respectively.

For assembly, the tray is pressed into the blank, wall strips and end strips opening outwards along their respective fold lines. Since portions are provided between the individual fold lines which have not been formed so as to fold, an elasticity is achieved for the wall strip or end strip, respectively, which presses wall or end strip against the side wall or end wall, respectively, of the tray.

Depending on what height or width the end and wall strips, respectively, are to have, a stamped-out portion is formed in the interior of the blank.

In a preferred embodiment, the blank consists of a cardboard layer which is coated with a layer of plastic, preferably a layer of polyethylene or a thermoplastic coating. This ensures that when a film is sealed on in a device in accordance with German Laid-Open Specifications 3,210,566 and 3,243,634, both the film is sealed onto the rim strip, and the supporting strip onto the rim strip from below in one working step.

Using this receptacle according to the invention, a container for products to be heated up is obtained which can be produced simply and cost-effectively. If this container is placed, for example, into a baking oven and heated to a temperature at which there is a risk of the inner tray deforming, the shape of the inner tray will nevertheless be reliably maintained by the support frame.

Furthermore, the ease of printing should also be mentioned as each wall part can be provided, for example after the blank has been formed, with a picture of the product, product information, a code or any other data.

Further advantages, features and details of the invention emerge from the following description of preferred exemplary embodiments and with reference to the drawing, in which FIG. 1 shows a perspective view of a receptacle according to the invention, for example for food;

Figure 1:
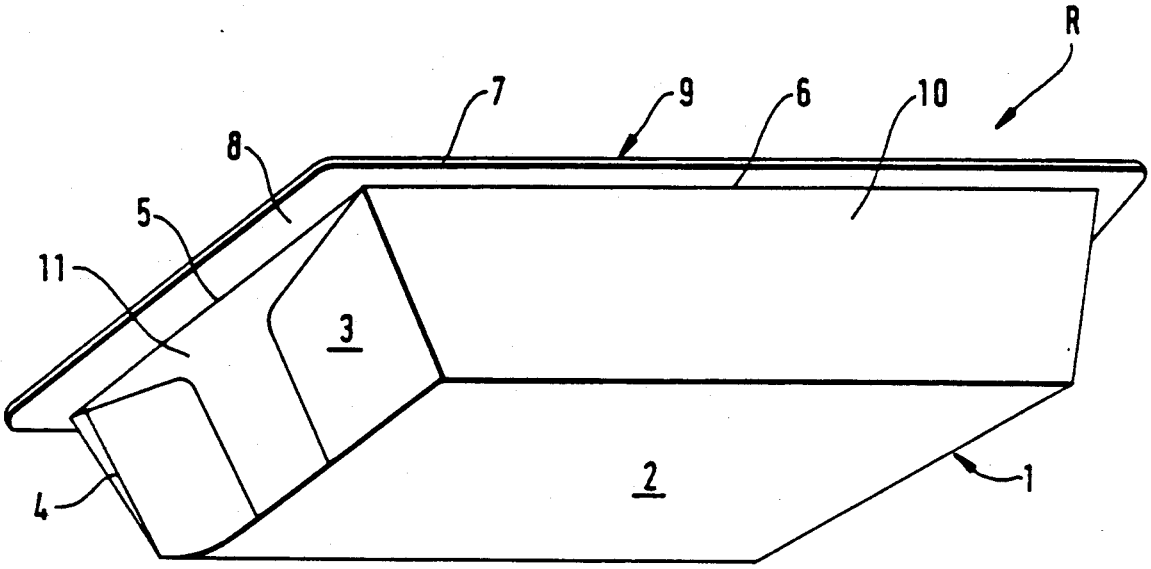

According to FIG. 1, a receptacle R has a tray 1 with base 2, end walls 3 and side walls 4. The upper rim edges 5 and 6 of the end walls 3 and side walls 4 are surrounded by a continuous rim strip 7.

In the use position, the rim strip 7 has placed beneath it a supporting strip 8 of a corresponding support frame 9. This support frame 9 then bears, furthermore, with wall strip 10 against side walls 4 and with end strip 11 against end walls 3.

A corresponding blank P for the support frame 9 exhibits the continuous support strip 8 which is separated from the wall strips 10 or from the end strips 11, respectively, by fold lines 12. The fold lines 12 may, for the sake of simplicity, be produced by intermittent line stamping. However, corresponding pressure stamping operations or perforations are also conceivable here.

The wall strips 10 have a width b. This width b corresponds to a height h of the end strips 11 such that both the bearing rim 13 of the end strips 11 and the bearing rim 14 of the wall strips 10 are situated in the same bearing plane in the use position according to FIG. 1. The width b and the height h are selected such that the base 2 either lies precisely in the bearing plane or slightly above or below it. If, as a result of the application of heat to the receptacle, a softening of the wall material of the receptacle 1 occurs, the end walls 3 and side walls 4 give way slightly, but the end strips 11 and wall strips 10 then assume the essential maintenance of the outer contour of the receptacle 1.

In the present exemplary embodiment, a stamped-out portion 15 is situated in the region between the bearing rims 13 and 14. The wall strips 10 of each side wall 4 of the receptacle 1 are, furthermore, adapted such that the end strip 11 just has the shape of a tongue which then widens out upwards in the shape of a funnel towards the corresponding fold lines.

The stamping lines between wall strips 10 and end strips 11 and up to the stamped-out portion 15 are to be characterized by 16.

Figure 3:
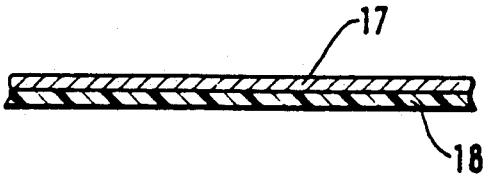
FIG. 3 shows an enlarged and only partially shown cross-section through the blank according to FIG. 2.
Figure 2:
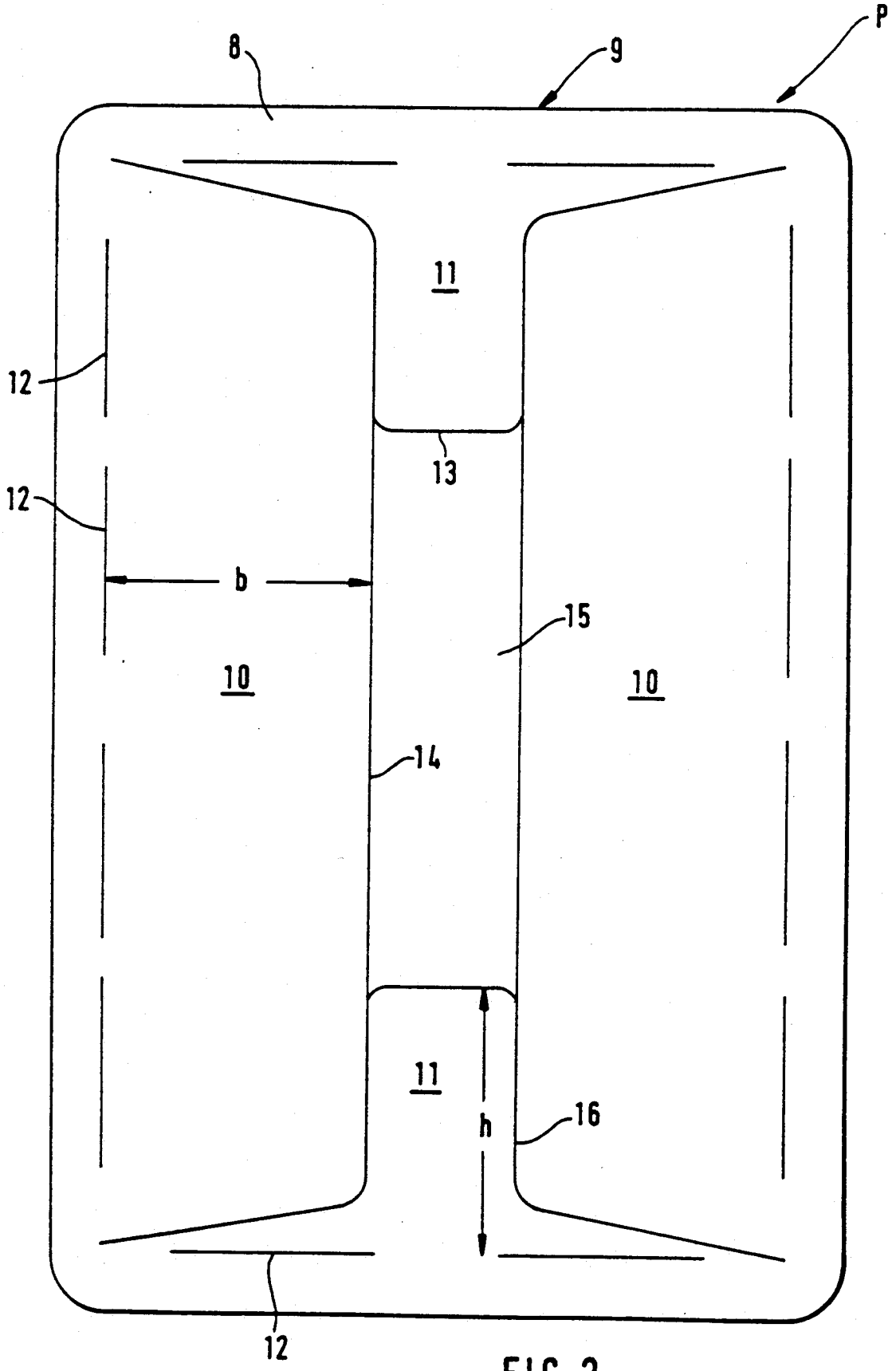
FIG. 2 shows a plan view of a blank of a support frame for the receptacle.

According to FIG. 3, a preferred embodiment of the support frame consists of a cardboard layer 17 which is coated with a layer of polyethylene 18. This PE layer 18 is assigned, in the use position, to the lower surface of the rim strip 7. The receptacle 1, together with the support frame 9, may then be placed into a reception trough known from German Laid-Open Specifications 3,210,566 and 3,243,634 and, after filling, be covered by a cover film. This receptacle is pushed, together with the cover film, into a heat-sealing device. By lowering this heat-sealing device, a welding of cover film onto the rim strip 7 is effected, and at the same time a welding of rim strip 7 to the PE layer 18 of the support frame 9.

As a result of the intermittent line stamping operations, the wall and end strips 10 and 11, respectively, are not folded out but merely bent out so that they bear resiliently against their corresponding end and side walls respectively and the use of the whole receptacle is not hindered. The cardboard layer, however, allows printing at any time in a simple manner, it being possible for this printing to take place independently as early as when the blank is produced. The cardboard can then be printed with a picture of the product, product information required by law, an EAN code, weight, eat-by date, price etc.

What is claimed is:

1. A receptacle for receiving products, in particular food to be heated up, which comprises: a container tray provided at least partially with an approximately horizontally projecting rim strip suitable for receiving a cover means therefor; and a blank supporting said container tray having an inside and a continuous supporting strip beneath the rim strip, said blank also including end strips and wall strips arranged towards the inside of the blank and separated from the supporting strip by fold lines, wherein the fold lines run inside that region of the blank covered by the rim strip, wherein said receptacle comprises an inner container tray and an outer blank which supports said container tray.

2. A receptacle according to claim 1 wherein the supporting strip has inner contours which are formed by the fold lines and outer contours spaced from the inner contours, said contours corresponding approximately to the dimension of the rim strip.

3. A receptacle according to claim 1 wherein the end strips and wall strips have bearing rims.

4. A receptacle according to claim 3 wherein the bearing rims of the wall strips have a width (b) from the respective fold line, and the bearing rims of the end strips have a height (h) from the respective fold line, the width (b) corresponding to the height (h).

5. A receptacle according to claim 4 wherein the container tray has side walls and end walls and wherein the width (b) and height (h), respectively, correspond approximately to the corresponding side wall and end wall, respectively.

6. A receptacle according to claim 1 wherein the container has side walls and end walls and wherein the outer contours of the wall strips and end strips correspond approximately to a side wall and end wall, respectively.

7. A receptacle according to claim 1 wherein the fold lines consist of individual linear formed parts between which unformed regions are situated.

8. A receptacle according to claim 1 wherein a stamped-out portion is formed in the blank between the wall strips and the end strips.

9. A receptacle according to claim 1 wherein the blank consists of a cardboard layer coated with a layer of plastic.

10. A receptacle according to claim 9 wherein the plastic layer is a polyester layer.

11. A receptacle according to claim 9 wherein the plastic layer is a water-soluble thermoplastic coating not harmful to the environment.

12. A receptacle according to claim 1 wherein said receptacle is suitable for being hermetically sealed in one working step.

13. A receptacle according to claim 1 wherein the blank is a member separate from the container tray and wherein the inner container tray is seated in the outer supporting blank.

* * * * *